US011828297B2

(12) United States Patent
Yamazaki et al.

(10) Patent No.: US 11,828,297 B2
(45) Date of Patent: Nov. 28, 2023

(54) AXIAL FAN

(71) Applicant: SANYO DENKI CO., LTD., Tokyo (JP)

(72) Inventors: Yoshihisa Yamazaki, Tokyo (JP); Kakuhiko Hata, Tokyo (JP); Shuji Miyazawa, Tokyo (JP)

(73) Assignee: SANYO DENKI CO., LTD., Tokyo (JP)

( * ) Notice: Subject to any disclaimer, the term of this patent is extended or adjusted under 35 U.S.C. 154(b) by 0 days.

(21) Appl. No.: 17/844,375

(22) Filed: Jun. 20, 2022

(65) Prior Publication Data

US 2023/0023454 A1 Jan. 26, 2023

(30) Foreign Application Priority Data

Jul. 20, 2021 (JP) ..... 2021-119447

(51) Int. Cl.
*F04D 29/54* (2006.01)
*F04D 19/00* (2006.01)
*F04D 29/64* (2006.01)

(52) U.S. Cl.
CPC ..... *F04D 29/545* (2013.01); *F04D 19/002* (2013.01); *F04D 29/544* (2013.01); *F04D 29/644* (2013.01)

(58) Field of Classification Search
CPC .... F04D 29/545; F04D 19/002; F04D 29/544; F04D 29/644
See application file for complete search history.

(56) References Cited

U.S. PATENT DOCUMENTS

2006/0042894 A1 3/2006 Lee et al.
2006/0045736 A1 3/2006 Lee et al.
2007/0048123 A1 3/2007 Chang et al.
2007/0147992 A1 6/2007 Yu et al.
2008/0118379 A1 5/2008 Uchise et al.
2014/0105763 A1* 4/2014 Ishihara ..... H05K 7/20172 417/354
2018/0142708 A1 5/2018 Horng et al.

FOREIGN PATENT DOCUMENTS

JP 4145906 B2 9/2008

OTHER PUBLICATIONS

Extended European Search Report (EESR) dated Dec. 8, 2022 for the corresponding European Patent Application No. 22179853.1.

* cited by examiner

*Primary Examiner* — Jacob M Amick
*Assistant Examiner* — Ruben Picon-Feliciano
(74) *Attorney, Agent, or Firm* — Rankin, Hill & Clark LLP

(57) ABSTRACT

Provided is an axial fan including: a rotor blade having a rotation axis along an air-blowing direction; and a casing, wherein the casing includes: an outer frame portion housing the rotor blade; a cylindrical base portion located on the rotation axis; and a fixed blade provided between an inner peripheral surface of the outer frame portion and an outer peripheral surface of the base portion and downstream of the rotor blade in the air-blowing direction, the fixed blade includes a wind receiving surface, and the wind receiving surface in a first cross section, along the air-blowing direction, of the fixed blade has a smaller blade curvature than the wind receiving surface in a second cross section of the fixed blade along a cutting plane line at a position moved in a rotation direction of the rotor blade from a cutting plane line of the first cross section.

6 Claims, 6 Drawing Sheets

AXIAL FAN

CROSS-REFERENCE TO RELATED APPLICATION

This application is based on Japanese Patent Application No. 2021-119447 filed with the Japan Patent Office on Jul. 20, 2021, the entire content of which is hereby incorporated by reference.

BACKGROUND

1. Technical Field

The present disclosure relates to an axial fan.

2. Related Art

A heat dispersing fan (axial fan) including fixed blades (stator blades) that are attached in such a manner as to have an inclination angle relative to a horizontal line perpendicular to the axis of the fan is disclosed in Japanese Patent No. 4145906.

SUMMARY

An axial fan according to an embodiment of the present disclosure is configured to send a wind in an air-blowing direction, and includes: a rotor blade configured to rotate about a rotation axis extending along the air-blowing direction; and a casing. The casing includes: an outer frame portion defining a columnar wind tunnel space where the rotor blade is housed; a cylindrical base portion located on the rotation axis; and a fixed blade provided between an inner peripheral surface of the outer frame portion and an outer peripheral surface of the base portion and downstream of the rotor blade in the air-blowing direction. The fixed blade includes a wind receiving surface upstream in the air-blowing direction. When a certain cross section of the fixed blade along the air-blowing direction is defined as a first cross section, and a cross section of the fixed blade along a cutting plane line at a position moved in a rotation direction of the rotor blade from a cutting plane line of the first cross section is defined as a second cross section, the wind receiving surface in the second cross section has a greater blade curvature than the wind receiving surface in the first cross section.

DETAILED DESCRIPTION

Figure 1:
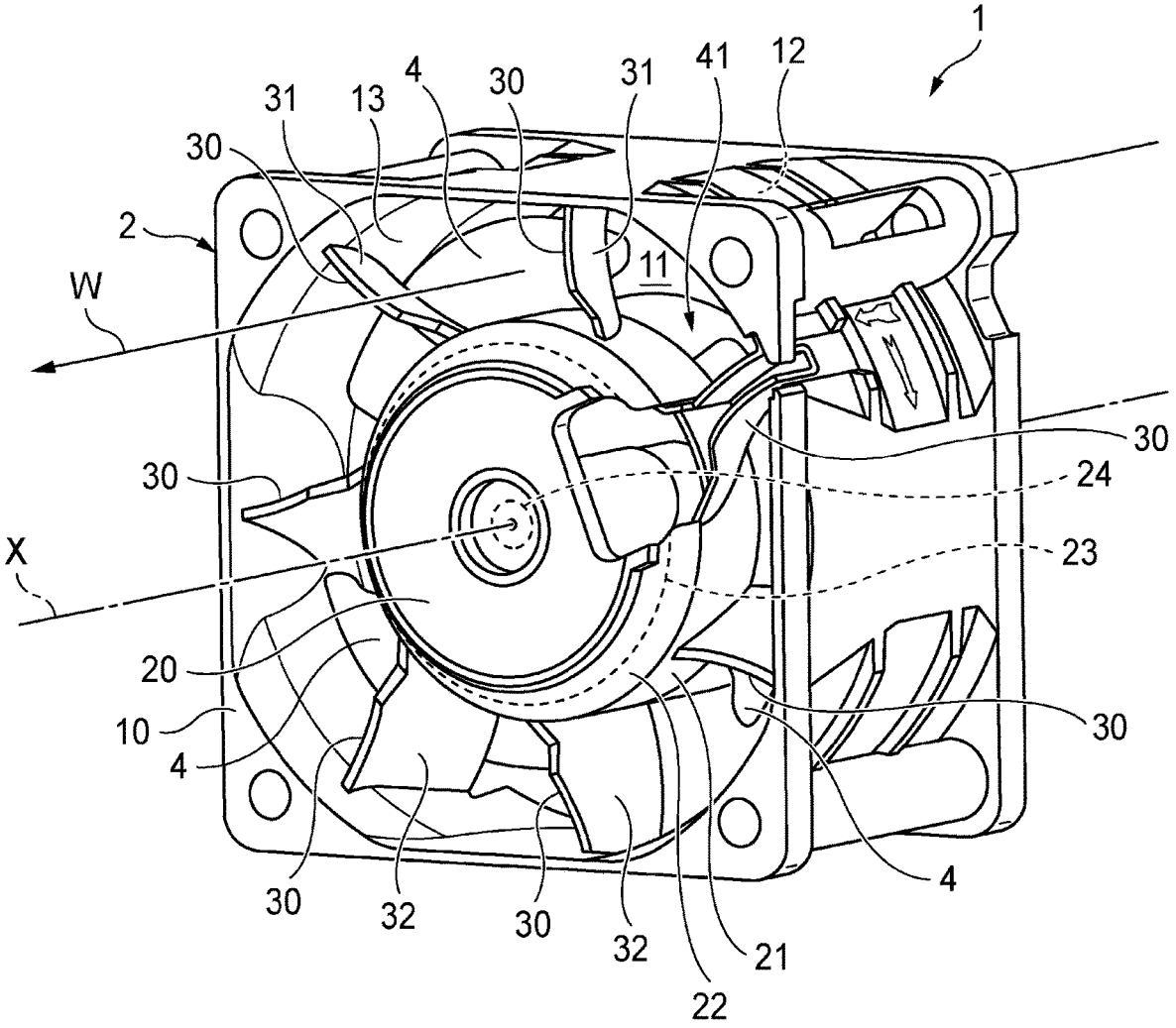
FIG. 1 is a perspective view of an axial fan according to an embodiment of the present disclosure.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

It is described that the heat dispersing fan disclosed in Japanese Patent No. 4145906 has the inclination angle between an upper end of the fixed blade and the horizontal line; hence, the working area near a hub increases and the distribution of wind all around the fixed blade can be made uniform. Moreover, it is also described that noise generated by a vortex can be eliminated by preventing build-up of air at the upper end of the fixed blade.

Japanese Patent No. 4145906 describes that the uniform wind distribution all around is realized by inclining the upper end of the fixed blade of the heat dispersing fan. However, it is not described that uniform wind distribution is realized by other configurations. Therefore, there is room for improvement in realizing uniform wind distribution by restraining variations in the wind distribution.

Hence, an object of an embodiment of the present disclosure is to provide an axial fan having small radial variations in wind distribution.

An axial fan according to one aspect of the present disclosure is configured to send a wind in an air-blowing direction, and includes: a rotor blade configured to rotate about a rotation axis extending along the air-blowing direction; and a casing. The casing includes: an outer frame portion defining a columnar wind tunnel space where the rotor blade is housed; a cylindrical base portion located on the rotation axis; and a fixed blade provided between an inner peripheral surface of the outer frame portion and an outer peripheral surface of the base portion and downstream of the rotor blade in the air-blowing direction. The fixed blade includes a wind receiving surface upstream in the air-blowing direction. When a certain cross section of the fixed blade along the air-blowing direction is defined as a first cross section, and a cross section of the fixed blade along a cutting plane line at a position moved in a rotation direction of the rotor blade from a cutting plane line of the first cross section is defined as a second cross section, the wind receiving surface in the second cross section has a greater blade curvature than the wind receiving surface in the first cross section.

According to the present disclosure, it is possible to provide an axial fan having small radial variations in wind distribution.

The embodiment is described hereinafter with reference to the drawings. Descriptions of members having the same reference numerals as members already described are omitted in the detailed description for the convenience of description. Moreover, the dimensions of each member illustrated in the drawings may be different from actual dimensions thereof for the convenience of description.

FIG. 1 is a perspective view illustrating an example of an axial fan according to the embodiment.

As illustrated in FIG. 1, an axial fan 1 is a fan that is configured in such a manner as to send a wind along an air-blowing direction W indicated by an arrow. The axial fan 1 includes a casing 2, and rotor blades 4 placed in the casing 2.

The casing 2 includes an outer frame portion 10, a base portion 20, and fixed blades 30.

The outer frame portion 10 defines a columnar wind tunnel space 11 communicating with an inlet 12 and an outlet 13 for wind (air). The rotor blades 4 are housed in the wind tunnel space 11. The wind that is drawn in through the inlet 12 with the rotation of the rotor blades 4 is delivered in the air-blowing direction W along the wind tunnel space 11, and sent to the outside through the outlet 13.

The base portion 20 is placed along a rotation axis X of the rotor blades 4 in a radially central part of the wind tunnel space 11 defined by the outer frame portion 10. The rotation axis X extends along the air-blowing direction W. The base portion 20 is formed into a cylindrical shape. Moreover, the base portion 20 includes a cylindrical portion 21 provided on the inlet 12 side that is upstream in the air-blowing direction W, and a tapered portion 22 provided on the outlet 13 side that is downstream in the air-blowing direction W.

The fixed blades 30 are stator blades that are configured in such a manner as to couple the base portion 20 to the outer frame portion 10. In other words, the base portion 20 is coupled to the outer frame portion 10 by the fixed blades 30. As a result, the base portion 20 is fixed in the radially central part of the wind tunnel space 11. The fixed blades 30 are provided between an inner peripheral surface of the outer frame portion 10 and an outer peripheral surface of the base portion 20. A radially outer end portion of the fixed blade 30 is connected to the inner peripheral surface of the outer frame portion 10. A radially inner end portion of the fixed blade 30 is connected to the outer peripheral surface of the base portion 20. The fixed blades 30 are provided downstream of the rotor blades 4 in the air-blowing direction W.

The fixed blade 30 is a stator blade formed in a shape of a thin plate. In the embodiment, the plurality of (seven in the example illustrated in the drawing) fixed blades 30 is provided radially. A surface of the fixed blade 30 that is upstream in the air-blowing direction W, that is to say, a surface of the fixed blade 30 that is located on the inlet 12 side, is defined as a "wind receiving surface" 31. Moreover, a surface that is downstream in the air-blowing direction W, that is to say, a surface that is located on the outlet 13 side, is defined as a "wind feeding surface" 32.

A motor 23 that drives the rotor blades 4 rotationally is fixed in the base portion 20. The motor 23 is configured, including a stator (illustration omitted) having a winding that is wound therearound, and a rotor (illustration omitted) having permanent magnets. The stator is fixed to the base portion 20. Consequently, the motor 23 is fixed to the outer frame portion 10 via the base portion 20 and the fixed blades 30.

The rotor blades 4 are attached to an outer peripheral surface of a rotor blade case 41 formed in a shape of a cup. In the wind tunnel space 11, the rotor blade case 41 to which the rotor blades 4 are attached is provided upstream of the base portion 20 and the fixed blades 30 in the air-blowing direction W. The rotor blade case 41 is fixed to a rotating shaft 24 of the motor 23. The plurality of permanent magnets configuring the rotor of the motor 23 is fixed to an inner peripheral surface of the rotor blade case 41. The rotor blades 4 rotate about the rotation axis X with the rotation of the rotating shaft 24, and send the wind in the air-blowing direction W.

Figure 2:
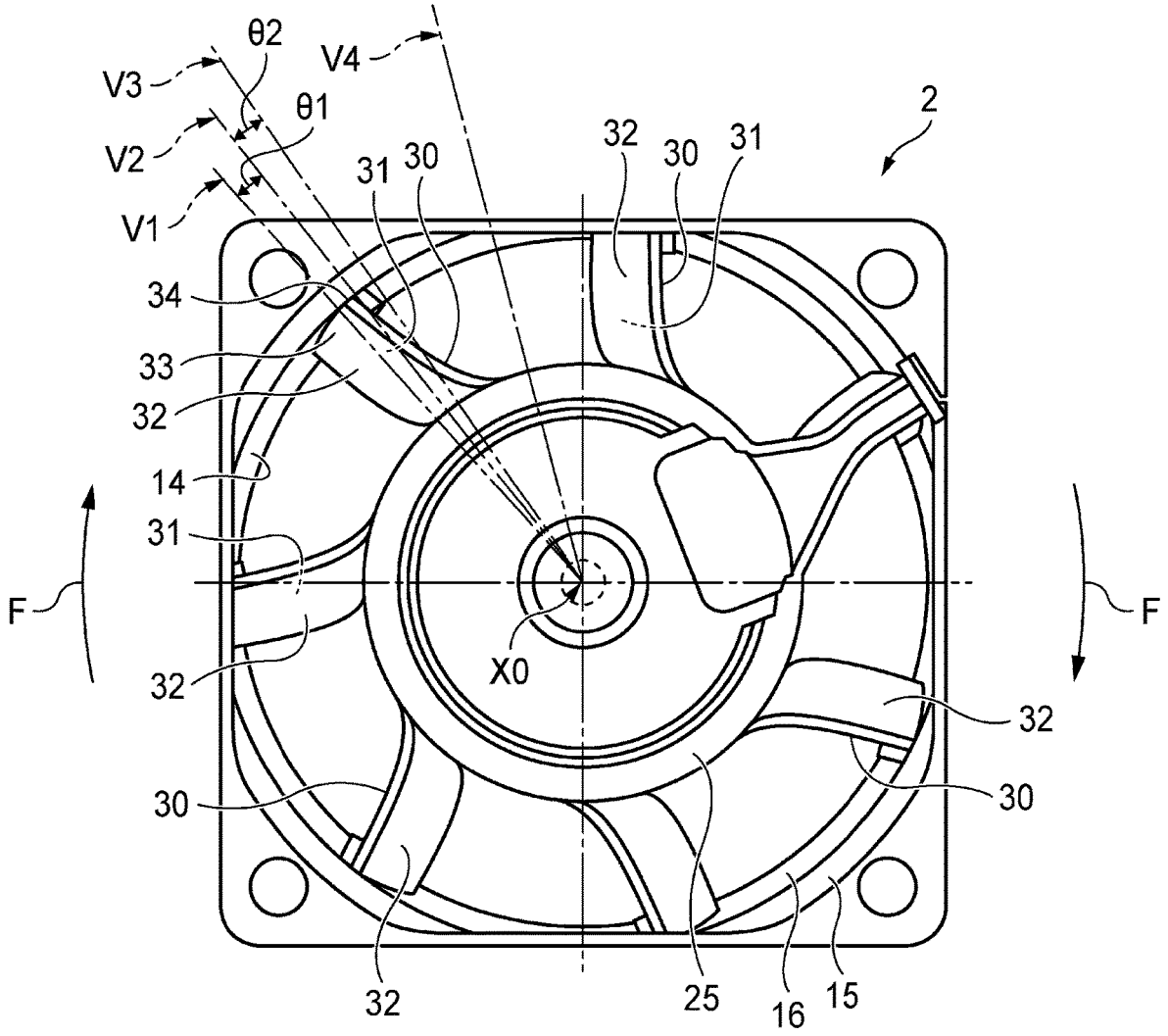
FIG. 2 is a plan view illustrating a casing of the axial fan.
Figure 3:
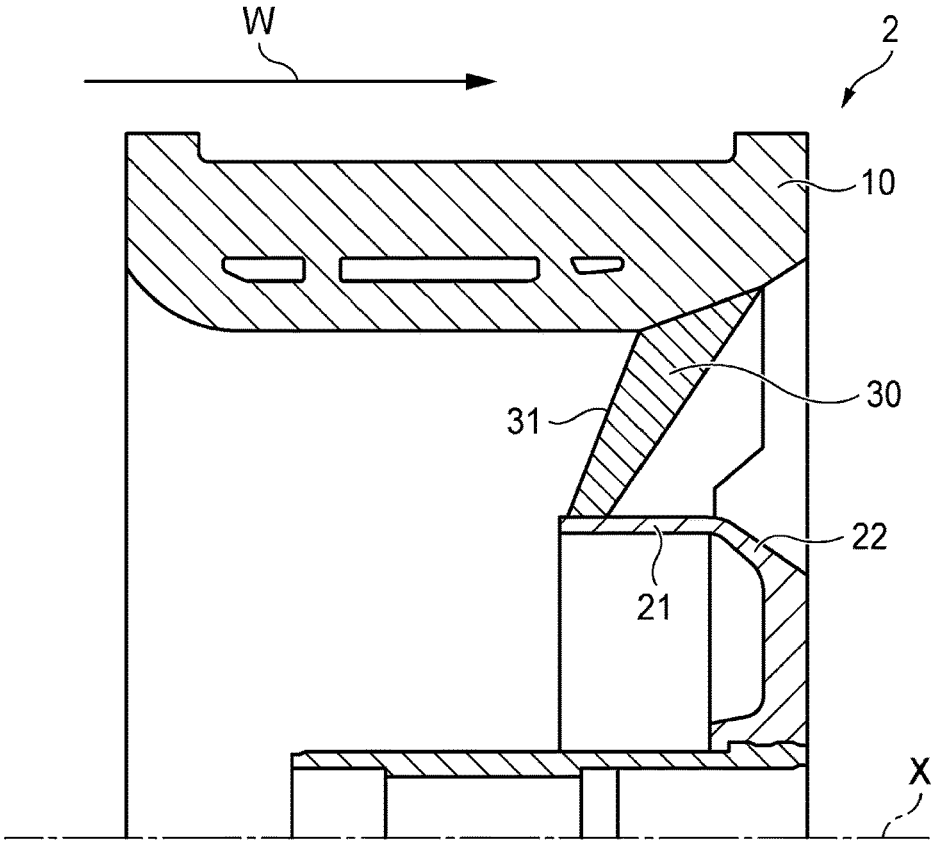
FIG. 3 is a cross-sectional view taken along X0-V1 in FIG. 2.
Figure 4:
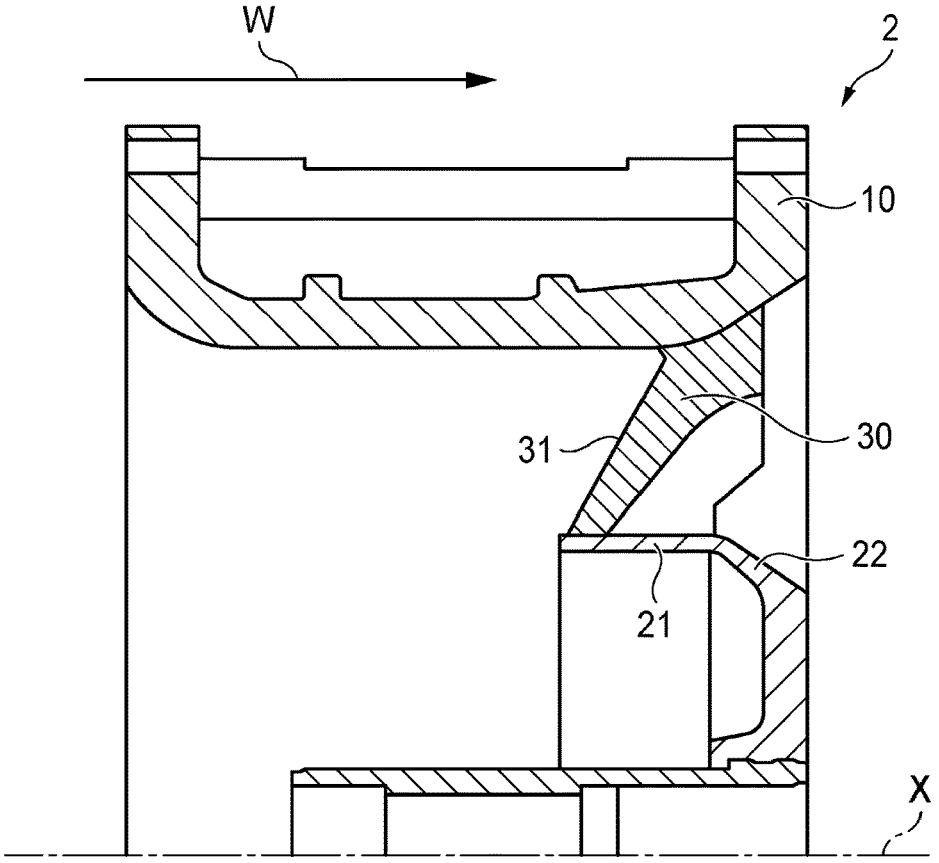
FIG. 4 is a cross-sectional view taken along X0-V2 in FIG. 2.
Figure 5:
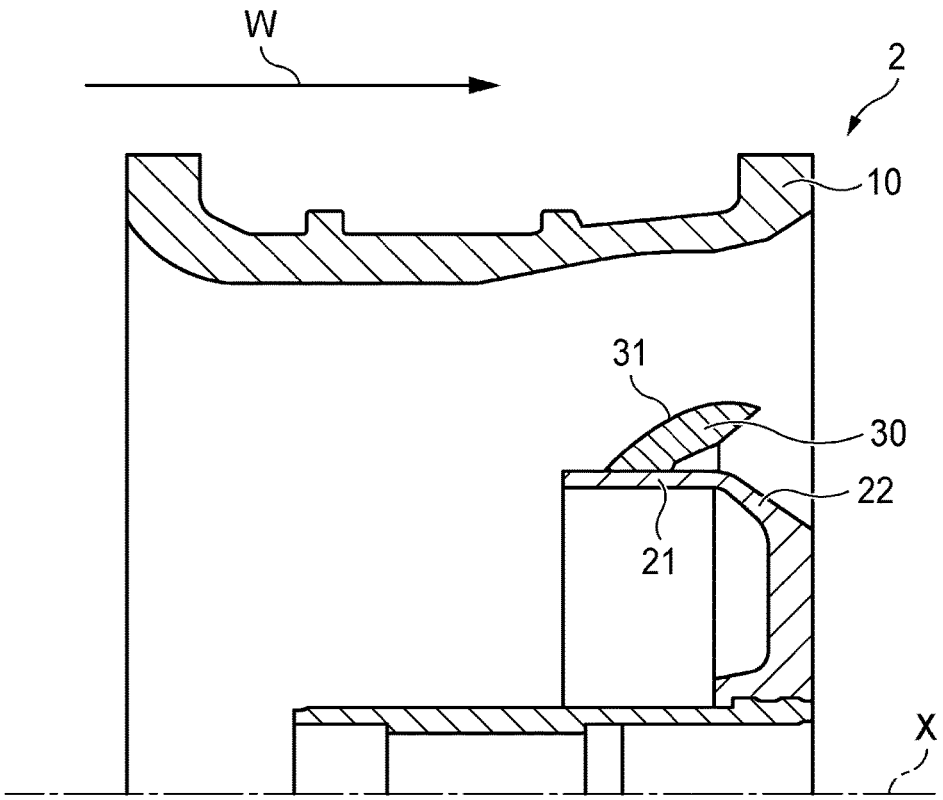
FIG. 5 is a cross-sectional view taken along X0-V3 in FIG. 2.

FIG. 2 is a plan view of the casing 2 as viewed from the downstream side in the air-blowing direction W, that is to say, the outlet 13 side in the wind tunnel space 11. Moreover, FIG. 3 is a cross-sectional view of the casing 2 along the air-blowing direction W, taken along line X0-V1 in FIG. 2. Similarly, FIG. 4 is a cross-sectional view taken along line X0-V2 in FIG. 2. Similarly, FIG. 5 is a cross-sectional view taken along line X0-V3 in FIG. 2. Lines X0-V1, X0-V2, and X0-V3 are cutting plane lines extending in the radial direction from the center point of the base portion 20.

In the examples illustrated in the drawings, the fixed blades 30 are connected to an inner peripheral surface 14 of the outer frame portion 10. Line X0-V1 is a cutting plane line passing through a downstream end 34, in the air-blowing direction W, of a radially outer end portion 33 of the fixed blade 30. Line X0-V2 is a cutting plane line passing through a position moved by rotating by a predetermined angle θ1 from line X0-V1 in a rotation direction F of the rotor blades 4. Line X0-V3 is a cutting plane line passing through a position moved by rotating further by a predetermined angle θ2 from line X0-V2 in the rotation direction F.

The wind receiving surface 31 of the fixed blade 30 of the axial fan 1 includes a portion having a convex shape in the air-blowing direction W (a convex portion), and/or a portion having a concave shape in the air-blowing direction W (a concave portion). The convex portion bulges toward the upstream side in the air-blowing direction W. The concave portion is recessed toward the downstream side in the air-blowing direction W. The convex portion and the concave portion each have a different curvature relative to the air-blowing direction W (hereinafter referred to as the blade curvature as appropriate). In other words, the convex portion has a positive blade curvature relative to the air-blowing direction W. On the other hand, the concave portion has a negative blade curvature.

Here, when a cross section, along the air-blowing direction W at a certain position, of the fixed blade 30 is defined as a "first cross section," a cross section along a cutting plane line at a position moved from a cutting plane line of the first cross section in the rotation direction F of the rotor blades 4 is defined as a "second cross section." In this case, the fixed blade 30 is configured in such a manner that the blade curvature of the wind receiving surface 31 in the second cross section is greater than the blade curvature of the wind receiving surface 31 in the first cross section.

In terms of the blade curvature of the wind receiving surface 31, for example, the cross sections taken along lines X0-V1, X0-V2, and X0-V3 in FIG. 2 have the following magnitude relationship on the basis of comparisons of the blade curvatures of the wind receiving surface 31.

The cross section along line X0-V2 is a cross section along the cutting plane line passing through the position moved by rotating by the angle θ1 in the rotation direction F of the rotor blades 4 from line X0-V1 passing through the downstream end 34 of the outer end portion 33 of the fixed blade 30. Therefore, the wind receiving surface 31 in the cross section along line X0-V2 (the second cross section) has a greater blade curvature than the wind receiving surface 31 in the cross section along line X0-V1 (the first cross section).

Moreover, the cross section along line X0-V3 is a cross section along the cutting plane line passing through the position moved by rotating further by the angle θ2 from line X0-V2 in the rotation direction F of the rotor blades 4. Therefore, the wind receiving surface 31 in the cross section along line X0-V3 (the second cross section) has a greater blade curvature than the wind receiving surface 31 in the cross section along line X0-V2 (the first cross section).

Specifically, for example, the wind receiving surface 31 of the fixed blade 30 is formed with a concave shape recessed toward the downstream side in the air-blowing direction W (an air-blowing direction side) in cross section along line X0-V1, as illustrated in FIG. 3. In other words, the wind receiving surface 31 in this cross section has a negative blade curvature.

Next, for example, the wind receiving surface 31 of the fixed blade 30 is formed with a convex shape bulging gently toward the upstream side in the air-blowing direction W (a direction opposite to the air-blowing direction) in cross section along line X0-V2, as illustrated in FIG. 4. In other words, the wind receiving surface 31 in this cross section has a gentle degree of curve, that is to say, a small positive blade curvature.

Next, for example, the wind receiving surface 31 of the fixed blade 30 is formed with a convex shape bulging toward the upstream side in the air-blowing direction W (the direction opposite to the air-blowing direction) in cross section along line X0-V3 (the second cross section), as illustrated in FIG. 5. The degree of bulging toward the upstream side is greater than the degree of bulging of the wind receiving surface 31 in the cross section along line X0-V2 (the first cross section) (refer to FIG. 4). In other words, the wind receiving surface 31 in the second cross section has a slightly sharper degree of curve than the wind receiving surface 31 in the cross section along line X0-V2 (the first cross section), that is to say, a great positive blade curvature. In this manner, the wind receiving surface 31 at a point further forward in the rotation direction F of the rotor blades 4 has a greater blade curvature.

Moreover, for example, on the wind receiving surface 31 of the fixed blade 30, a portion located most upstream in the rotation direction F of the rotor blades 4, that is to say, a portion located at an end portion in a direction opposite to the rotation direction F of the rotor blades 4 is formed with a concave shape recessed toward the downstream side in the air-blowing direction W.

Moreover, for example, on the wind receiving surface 31 of the fixed blade 30, a portion located most downstream in the rotation direction F of the rotor blades 4, that is to say, a portion located at an end portion in the same direction as the rotation direction F of the rotor blades 4 is formed with a convex shape bulging toward the upstream side in the air-blowing direction W.

Figure 6:
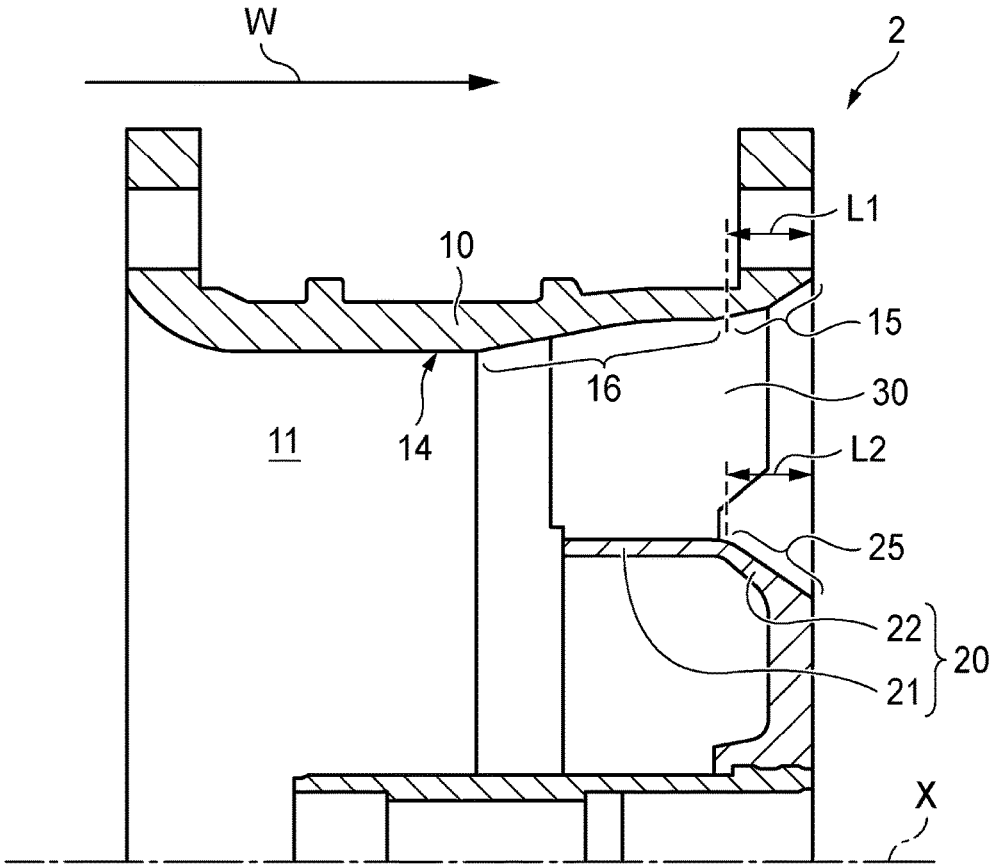
FIG. 6 is a diagram illustrating increased-diameter portions of an outer frame portion and a base portion.

FIG. 6 is a cross-sectional view of the casing 2 along the air-blowing direction W, taken along line X0-V4 in FIG. 2. FIG. 6 is a diagram illustrating increased-diameter portions provided to the outer frame portion 10 and the base portion 20.

As illustrated in FIG. 6, an outer frame rear increased-diameter portion 15 to increase the diameter of the wind tunnel space 11 is provided to an outer frame rear end portion, which is an end portion that is downstream in the air-blowing direction W, on the inner peripheral surface 14 of the outer frame portion 10. The outer frame rear increased-diameter portion 15 is formed in such a manner as to increasingly incline outward in the radial direction toward the downstream side in the air-blowing direction W. In other words, the diameter of the wind tunnel space 11 increases toward the outlet 13 of the wind tunnel space 11, and also the outlet 13 expands. The slope of the outer frame rear increased-diameter portion 15 may be, for example, a flat slope, or an arc-shaped slope.

Furthermore, an outer frame inner increased-diameter portion 16 to increase the diameter of the wind tunnel space 11 is provided upstream of the outer frame rear increased-diameter portion 15 in the air-blowing direction W on the inner peripheral surface 14 of the outer frame portion 10. The outer frame inner increased-diameter portion 16 is formed in such a manner as to increasingly incline outward in the radial direction toward the downstream side in the air-blowing direction W. In other words, the diameter of the wind tunnel space 11 increases toward the outer frame rear increased-diameter portion 15. The outer frame inner increased-diameter portion 16 is continuous with the outer frame rear increased-diameter portion 15. In other words, a downstream end portion of the outer frame inner increased-diameter portion 16 in the air-blowing direction W is coupled to an upstream end portion of the outer frame rear increased-diameter portion 15 in the air-blowing direction W. The slope of the outer frame inner increased-diameter portion 16 may be, for example, a flat slope, or an arc-shaped slope.

Moreover, a base increased-diameter portion 25 to increase the diameter of the wind tunnel space 11 is provided to a base rear end portion, which is an end portion that is downstream in the air-blowing direction W, on the outer peripheral surface of the base portion 20. The base increased-diameter portion 25 includes an inclined surface on the tapered portion 22 of the base portion 20. The base increased-diameter portion 25 is formed in such a manner as to increasingly incline inward in the radial direction toward the downstream side in the air-blowing direction W. In other words, the diameter of the wind tunnel space 11 increases toward the outlet 13 of the wind tunnel space 11, and the outlet 13 expands. The slope of the base increased-diameter portion 25 may be, for example, a flat slope, or an arc-shaped slope. A length L2 of the base increased-diameter portion 25 in the air-blowing direction W is set in such a manner as to be substantially equal to a length L1, in the air-blowing direction W, of the outer frame rear increased-diameter portion 15 provided to the inner peripheral surface 14 of the outer frame portion 10.

Figure 7:
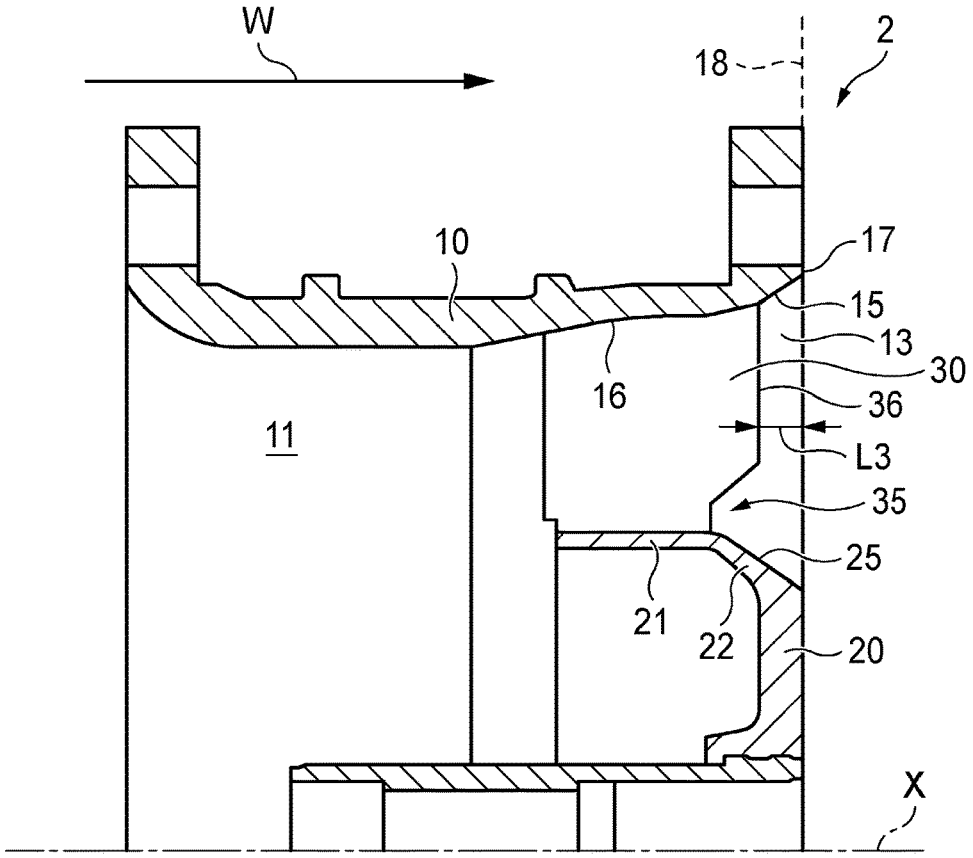
FIG. 7 is a diagram illustrating the configuration of a fixed blade.

FIG. 7 is a cross-sectional view of the casing 2 along the air-blowing direction W, taken along line X0-V4 in FIG. 2. FIG. 7 illustrates the configuration of the fixed blade 30.

As illustrated in FIG. 7, the radially outer end portion of the fixed blade 30 is connected to the outer frame portion 10 over the outer frame inner increased-diameter portion 16 and the outer frame rear increased-diameter portion 15. Moreover, the radially inner end portion of the fixed blade 30 is connected to an outer peripheral surface of the cylindrical portion 21 of the base portion 20. The shape of the wind receiving surface 31 having a varying blade curvature is formed in such a manner that the shape of a radially outer portion of the wind receiving surface 31 is continuous with the slopes, which are for increasing the diameter, of the outer frame inner increased-diameter portion 16 and the outer frame rear increased-diameter portion 15 of the outer frame portion 10. Similarly, the shape of a radially inner side of the wind receiving surface 31 is formed in such a manner as to be continuous with the slope, which is for increasing the diameter, of the base increased-diameter portion 25 of the base portion 20.

The inner end portion of the fixed blade 30 is not connected to an outer peripheral surface of the tapered portion 22 of the base portion 20. In other words, the inner end portion of the fixed blade 30 is not connected to the base increased-diameter portion 25 of the base portion 20. A downstream edge portion, in the air-blowing direction W, of the inner end portion of the fixed blade 30 extends outward in the radial direction from the place connected to the cylindrical portion 21. The downstream edge portion then inclines downstream in the air-blowing direction W and outward in the radial direction. The downstream edge portion extends further outward in the radial direction again, and is connected to the outer frame rear increased-diameter portion 15 of the outer frame portion 10. Hence, the fixed blade 30 is not connected to the base increased-diameter portion 25 of the base portion 20. However, the fixed blade 30 is provided in such a manner as to overhang the periphery of the base increased-diameter portion 25 at a position away from the base increased-diameter portion 25. A rear end portion, which is located downstream in the air-blowing direction W, of the fixed blade 30 at the joint between the fixed blade 30 and the base portion 20 is provided with a cutout 35 that is recessed into the upstream side in the air-blowing direction W and separates the fixed blade 30 and the base increased-diameter portion 25.

A blade rear end portion 36 is an end portion of the fixed blade 30 that is located downstream in the air-blowing direction W. The fixed blade 30 is attached in such a manner that the blade rear end portion 36 is located upstream (forward) of an outer frame rearmost end portion 17 in the air-blowing direction W. The outer frame rearmost end portion 17 is an end portion of the outer frame portion 10 that is located most downstream in the air-blowing direction W. In other words, the blade rear end portion 36 of the fixed blade 30 is provided in such a manner as to be recessed into the wind tunnel space 11 relative to an outlet line 18 defined by an edge of the outlet 13 of the wind tunnel space 11. A distance of the blade rear end portion 36 recessed into the wind tunnel space 11 from the outlet line 18 is defined as a recess distance L3. The recess distance L3 is set in such a manner as to be less than the above-mentioned length L1 of the outer frame rear increased-diameter portion 15 and length L2 of the base increased-diameter portion 25.

As described above, the axial fan 1 of the embodiment includes the rotor blades 4 that rotate about the rotation axis X extending along the air-blowing direction W, and the casing 2. The casing 2 includes the outer frame portion 10 defining the columnar wind tunnel space 11 where the rotor blades 4 are housed, the cylindrical base portion 20 located on the rotation axis X, and the fixed blades 30 provided between the inner peripheral surface 14 of the outer frame portion 10 and the outer peripheral surface of the base portion 20 and downstream of the rotor blades 4 in the air-blowing direction W. The fixed blades 30 each include the wind receiving surface 31 located upstream in the air-blowing direction W. When the certain cross section of the fixed blade 30 along the air-blowing direction W is defined as the first cross section, the cross section of the fixed blade 30 along the cutting plane line at a position moved from the cutting plane line of the first cross section in the rotation direction F of the rotor blades 4 is defined as the "second cross section." In this case, the wind receiving surface 31 in the second cross section has a greater blade curvature than the wind receiving surface 31 in the first cross section. With this configuration, the fixed blade 30 is formed in such a manner that the wind receiving surface 31 in a cross section along a cutting plane line further forward in the rotation direction F of the rotor blades 4 has a greater blade curvature. As a result, it is possible to smoothly send the wind flowing through the immediate vicinity of the fixed blade 30 to the outlet 13 of the wind tunnel space 11. Hence, it is possible to restrain radial variations in the wind to be sent to the outside through the outlet 13.

Moreover, in the axial fan 1, the portion of the wind receiving surface 31 that is located most upstream in the rotation direction F is recessed toward the downstream side in the air-blowing direction W. On the other hand, the portion of the wind receiving surface 31 that is located most downstream in the rotation direction F bulges toward the upstream side in the air-blowing direction W. The wind receiving surface 31 has such a changing concavo-convex shape. Therefore, it is possible to restrain radial variations in the wind to be sent to the outside through the outlet 13.

Moreover, according to the axial fan 1, the outer frame portion 10 includes the outer frame rear end portion, which is the end portion that is downstream in the air-blowing direction W, on the inner peripheral surface 14 of the outer frame portion 10. The outer frame rear end portion is provided with the outer frame rear increased-diameter portion 15 to increase the diameter of the wind tunnel space 11 toward the downstream side in the air-blowing direction W. Moreover, the base portion 20 includes the base rear end portion, which is the end portion that is downstream in the air-blowing direction W, on the outer peripheral surface of the base portion 20. The base rear end portion is provided with the base increased-diameter portion 25 to increase the diameter of the wind tunnel space 11 toward the downstream side in the air-blowing direction W. Hence, the outer frame rear increased-diameter portion 15 can restrain the entrainment and separation of the wind to flow out to the outside from near the radially outer side of the wind tunnel space 11. In this manner, the wind flowing out from the wind tunnel space 11 to the outside can be dispersed over a wide area. Moreover, the base increased-diameter portion 25 can restrain the entrainment and separation of the wind to flow out to the outside from near the radially inner side of the wind tunnel space 11. In this manner, the wind flowing out from the wind tunnel space 11 to the outside can be dispersed over a wide area. Consequently, it is possible to further restrain radial variations in the wind to be sent to the outside through the outlet 13 and to make the volume of air uniform.

Moreover, according to the axial fan 1, the rear end portion, which is located downstream in the air-blowing direction W, of the fixed blade 30 at the joint between the fixed blade 30 and the base portion 20 is provided with the cutout 35. Hence, it is possible to guide the wind flowing from the upstream side in the air-blowing direction W, from the cutout 35 to the base increased-diameter portion 25 of the base portion 20. Consequently, it is possible to further disperse the wind that is sent to the outside from near the radially inner side of the wind tunnel space 11.

Moreover, the rear end portion of the fixed blade 30 in the air-blowing direction W is located forward of a rear end portion of the casing 2 in the axial fan 1. In a configuration of an axial fan including a rear end portion of a fixed blade placed up to a rear end portion of a casing, a sudden pressure change is added to the wind that is guided by the fixed blade and flows from the inside to the outside of the fan. Hence, the sudden pressure change becomes a cause of the generation of noise. In contrast, according to the present axial fan 1, the rear end region of the casing 2 is provided with a region without the fixed blade. Hence, it is possible to make gentle a change in the pressure of the wind that is guided by the fixed blade 30 and flows to the outside of the fan. Hence, it is possible to prevent the generation of noise. Moreover, cooperation among the fixed blade 30 with this configuration, the outer frame rear increased-diameter portion 15 connected to the fixed blade 30, and the base increased-diameter portion 25 enables further increasing the radial uniformity of the wind to be sent to the outside through the outlet 13.

Moreover, according to the axial fan 1, the upstream side, in the air-blowing direction W, of the outer frame rear increased-diameter portion 15 on the inner peripheral surface 14 of the outer frame portion 10 is provided with the outer frame inner increased-diameter portion 16 to increase the diameter of the wind tunnel space 11 toward the downstream side in the air-blowing direction W. Hence, it is possible to guide the wind flowing in the wind tunnel space 11 to the outer frame rear increased-diameter portion 15 via the outer frame inner increased-diameter portion 16. Hence, it is possible to smoothly disperse the wind that is sent to the outside from near the radially outer side of the wind tunnel space 11.

Figure 8:
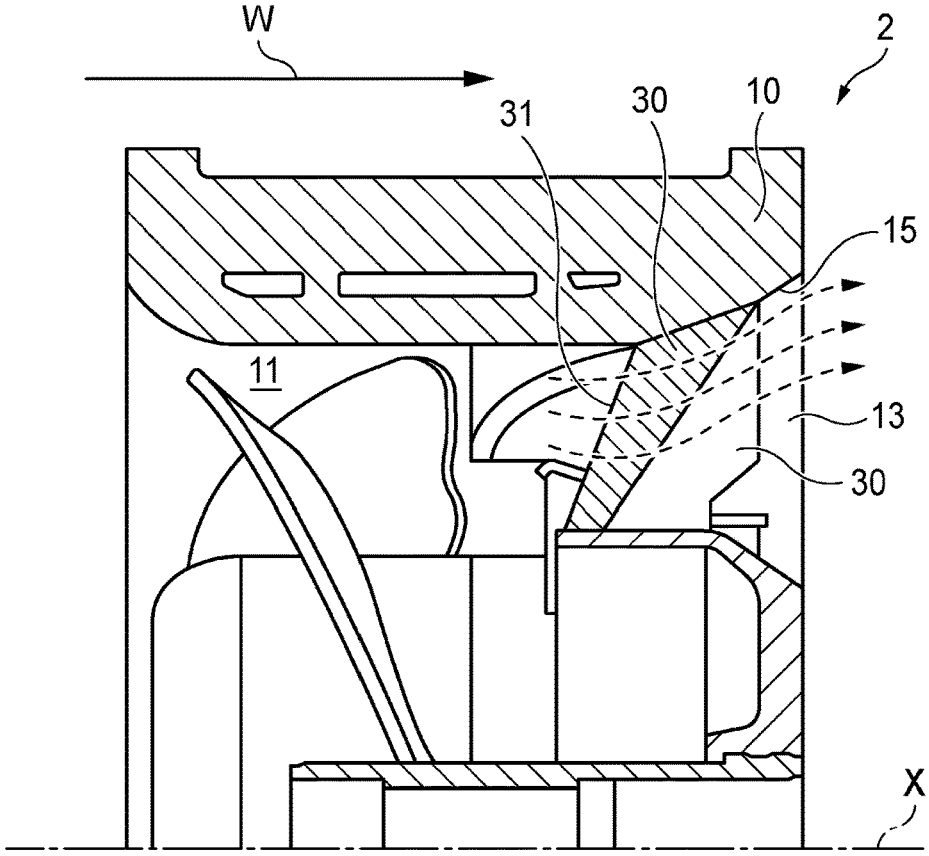
FIG. 8 is a diagram illustrating the flow of wind in a peripheral part of an outlet.
Figure 9:
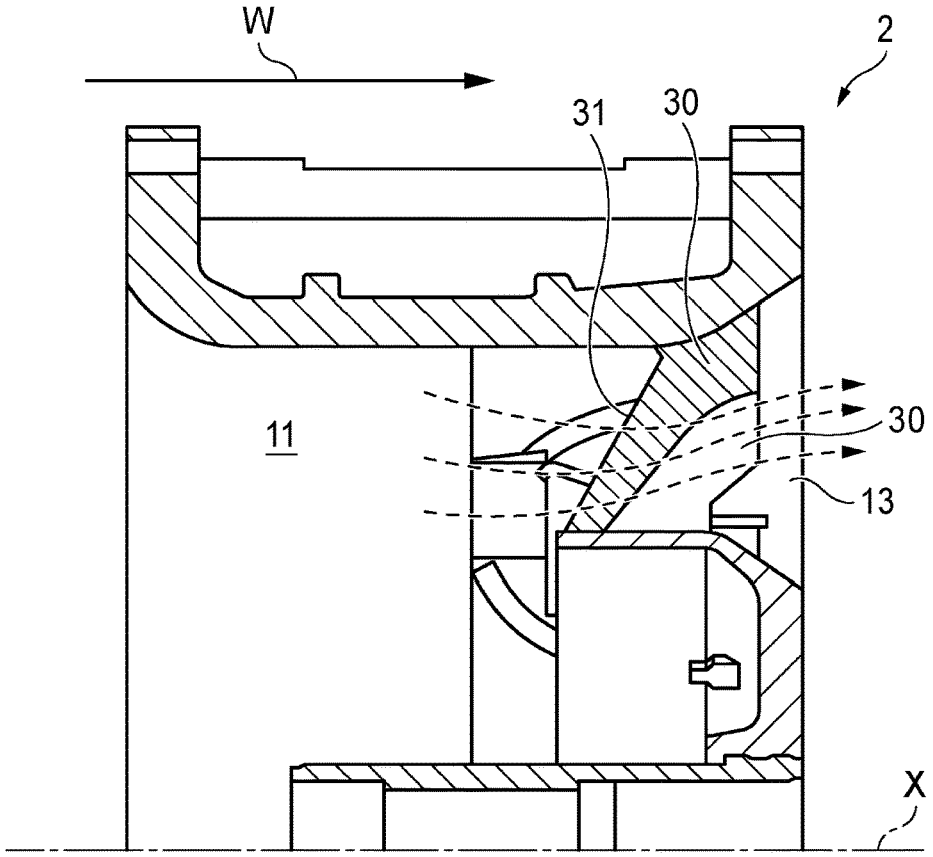
FIG. 9 is a diagram illustrating the flow of wind in an intermediate part of the outlet.
Figure 10:
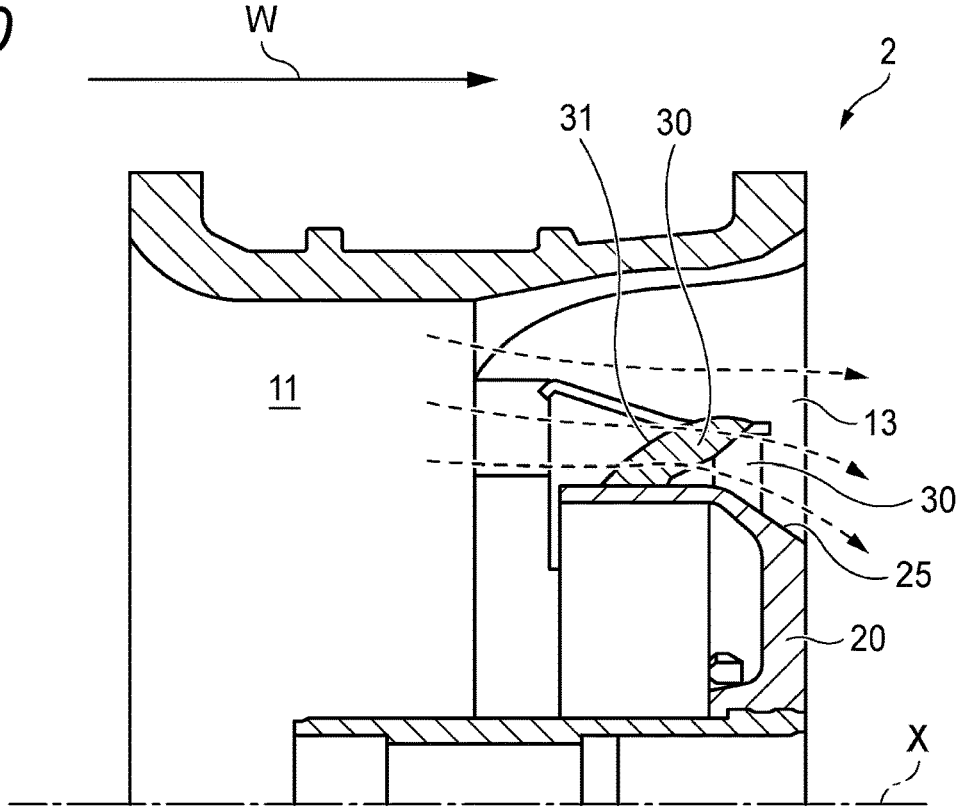
FIG. 10 is a diagram illustrating the flow of wind in a central part of the outlet.

FIG. 8 is a cross-sectional view illustrating the wind that flows to a peripheral part of the outlet 13 through the immediate vicinity of the fixed blade 30. FIG. 9 is a cross-sectional view illustrating the wind that flows to an intermediate part of the outlet 13 through the immediate vicinity of the fixed blade 30. FIG. 10 is a cross-sectional view illustrating the wind that flows to a central part (inner part) of the outlet 13 through the immediate vicinity of the fixed blade 30.

As indicated by arrows in FIG. 8, the wind flowing to the peripheral part of the outlet 13 through the immediate vicinity of the fixed blade 30 passes smoothly through the immediate vicinity of the fixed blade 30 in accordance with the blade curvature of the wind receiving surface 31 of the fixed blade 30, and flows to the peripheral part of the outlet 13. The wind that has flown to the peripheral part of the outlet 13 flows out in such a manner as to be dispersed outward in the radial direction over a wide area along the outer frame rear increased-diameter portion 15 of the outer frame portion 10. Moreover, the fixed blade 30 that is recessed into the wind tunnel space 11 relative to the outlet 13 makes the wind in the peripheral part of the outlet 13 a smoother stream of air to disperse the air over a wide area.

As indicated by arrows in FIG. 9, the wind that flows to the intermediate part of the outlet 13 through the immediate vicinity of the fixed blade 30 passes smoothly through the immediate vicinity of the fixed blade 30 in accordance with the blade curvature of the wind receiving surface 31 of the fixed blade 30, and flows to the intermediate part of the outlet 13. The fixed blade 30 that is recessed into the wind tunnel space 11 relative to the outlet 13 causes the wind that has flown to the intermediate part of the outlet 13 to flow out smoothly along the air-blowing direction W.

As indicated by arrows in FIG. 10, the wind that flows to the central part of the outlet 13 through the immediate vicinity of the fixed blade 30 passes smoothly through the immediate vicinity of the fixed blade 30 in accordance with the blade curvature of the wind receiving surface 31 of the fixed blade 30, and flows to the central part of the outlet 13. The wind that has flown to the central part of the outlet 13 flows out in such a manner as to be dispersed inward in the radial direction over a wide area along the base increased-diameter portion 25 of the base portion 20. Moreover, the fixed blade 30 that is recessed into the wind tunnel space 11 relative to the outlet 13 makes the wind in the central part of the outlet 13 a smoother stream of air to disperse the air over a wide area. As illustrated in FIGS. 8 to 10, the axial fan 1 can make the wind to be sent to the outside through the outlet 13 uniform in the radial direction.

Up to this point the embodiment has been described. However, it is needless to say that the technical scope of the embodiment should not be construed in a limited manner by the description of the above-mentioned embodiment. The embodiment is a mere example. Those skilled in the art understand that the above-mentioned embodiment can be modified in various manners within the scope of disclosure described in the claims. The technical scope of the embodiment should be determined on the basis of the scope of disclosure described in the claims and the scope of equivalents thereof.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. An axial fan configured to send a wind in an air-blowing direction, comprising:

a rotor blade configured to rotate about a rotation axis extending along the air-blowing direction; and a casing, wherein the casing includes:

an outer frame portion defining a columnar wind tunnel space where the rotor blade is housed;

a cylindrical base portion located on the rotation axis; and a fixed blade provided between an inner peripheral surface of the outer frame portion and an outer peripheral surface of the base portion and downstream of the rotor blade in the air-blowing direction, the fixed blade includes a wind receiving surface upstream in the air-blowing direction, when a certain cross section of the fixed blade along the air-blowing direction is defined as a first cross section, and a cross section of the fixed blade along a cutting plane line at a position moved in a rotation direction of the rotor blade from a cutting plane line of the first cross section is defined as a second cross section, the first cross section including the rotation axis of the rotor blade, the second cross section including the rotation axis of the rotor blade, the wind receiving surface in the second cross section has a greater blade curvature than the wind receiving surface in the first cross section, the wind receiving surface in the first cross section is formed with a concave shape recessed in the air-blowing direction, and the wind receiving surface in the second cross section is formed with a convex shape bulged in the air-blowing direction.

2. The axial fan according to claim 1, wherein a rear end portion, in the air-blowing direction, of the inner peripheral surface of the outer frame portion includes a first increased-diameter portion to increase a diameter of the wind tunnel space toward a downstream side in the air-blowing direction, and a rear end portion, in the air-blowing direction, of the outer peripheral surface of the base portion includes a second increased-diameter portion to increase the diameter of the wind tunnel space toward the downstream side in the air-blowing direction.

3. The axial fan according to claim 1, wherein a rear end portion of the fixed blade in the air-blowing direction includes a cutout at a joint between the fixed blade and the base portion.

4. The axial fan according to claim 1, wherein a rear end portion of the fixed blade in the air-blowing direction is located forward in the air-blowing direction relative to a rear end portion of the casing in the air-blowing direction.

5. The axial fan according to claim 1, wherein a portion, which is located most upstream in the rotation direction, of the wind receiving surface is recessed toward a downstream side in the air-blowing direction, and a portion, which is located most downstream in the rotation direction, of the wind receiving surface bulges toward an upstream side in the air-blowing direction.

6. The axial fan according to claim 2, wherein the inner peripheral surface of the outer frame portion includes a third increased-diameter portion to increase the diameter of the wind tunnel space toward the downstream side in the air-blowing direction, upstream of the first increased-diameter portion in the air-blowing direction.

* * * * *